United States Patent [19]

Parrish et al.

[11] 4,132,457

[45] Jan. 2, 1979

[54] PROTECTIVE COVER FOR WEDDING CAKES, OR OTHER DISPLAY ITEMS

[76] Inventors: Richard A. Parrish, 2070 Swan Dr., Costa Mesa, Calif. 92626; Douglas R. Parrish, 10085 Sunn Cir., Fountain Valley, Calif. 92708

[21] Appl. No.: 664,659

[22] Filed: Mar. 8, 1976

Related U.S. Application Data

[63] Continuation-in-part of Ser. No. 520,267, Nov. 4, 1974, Pat. No. 3,957,327.

[51] Int. Cl.[2] ..... A47B 47/00

[52] U.S. Cl. ..... 312/284; 220/4 E

[58] Field of Search ..... 312/284; 220/4 E; 24/213 CS

[56] References Cited

U.S. PATENT DOCUMENTS

| | | | |
|---|---|---|---|
| 3,092,277 | 6/1963 | Brim | 220/4 E |
| 3,181,411 | 5/1965 | Mejlso | 24/213 CS |
| 3,238,586 | 3/1966 | Stoffel | 24/213 CS |
| 3,550,804 | 12/1970 | De Remmer | 200/4 E |
| 3,843,220 | 10/1974 | Snider | 312/204 |
| 3,957,327 | 5/1976 | Parrish | 312/284 |

*Primary Examiner*—Casmir A. Nunberg
*Attorney, Agent, or Firm*—Romney, Schaap, Golant, Scillieri, Disner & Ashen

[57] ABSTRACT

A transparent frusto-conical protective cover for a wedding cake, or other articles on a support member, the cover having a body portion comprising upstanding upwardly convergent walls. The walls overlap and are removably fastened at their edges. The bottom edge of the cover abuts the support member a distance from the outer edge of the cake or article so that the object is enclosed within the conical member.

5 Claims, 10 Drawing Figures

PROTECTIVE COVER FOR WEDDING CAKES, OR OTHER DISLAY ITEMS

CROSS REFERENCE TO RELATED APPLICATION

This application is a continuation-in-part of my copending application Ser. No. 520,267, filed Nov. 4, 1974, now U.S. Pat. No. 3,957,327.

BACKGROUND OF THE INVENTION

The present invention relates in general to a protective cover for wedding cakes, or other display items.

As is well known, wedding cakes are frequently very elaborate structures which may attain substantial heights. Desirably, wedding cakes should be protected against contamination between the time they are completed and the time they are cut during the receptions which customarily follow weddings. In the past, all kinds of makeshift covers have been used for protective purposes, but, to my knowledge, none of these have been completely satisfactory.

OBJECTS AND SUMMARY OF THE INVENTION

In view of the foregoing, the primary object of the invention is to provide a very simple and effective protective cover for wedding cakes, or other articles, and one which takes up a minimum of space when not in use.

More particularly, an important object of the invention is to provide a self-sustaining protective cover, and one which is preferably a transparent flexible material, such as a suitable plastic, so that the wedding cake, or other articles, may be viewed therethrough readily.

One embodiment of the invention may be summarized as comprising, and an important object of the invention is to provide a cover which comprises, a housing, preferably upwardly convergent, divided into at least two identical sections in the vertical direction, the cover sections being positionable in face-to-face relation to form the cover and being positionable in nested relation when the cover is not in use, as when it is being returned to the bakery, for example, or being stored. Still another important object to to provide seam means integral with the cover sections for removably connecting same with the cover sections in their face-to-face relation, and also in their nested relation.

Still another object of the invention is to provide a frusto-conical protective cover wherein the cover sections are provided with upwardly convergent edges having outwardly extending, upwardly convergent flanges in which the seam means mentioned are formed.

Yet another object is to provide a protective cover wherein the seam means comprise interlocking means on said body portion for interlocking the upwardly convergent flanges mentioned, each channel on each of the cover sections being interlockable with one of the channels on another of the cover sections when the cover sections are in their face-to-face relation, and being interlockable with one of the channels on another cover section when the cover sections are in their nested relation.

An additional object is to provide a construction wherein the interlocking channels are interlockable with snap fits, a relation object being to provide the channels with dovetail cross sections.

A further object is to provide the cover sections at their lower ends with outwardly extending base flanges which cooperate to provide a continuous, annular base flange to stabilize the frusto-conical cover when the cover sections are in their face-to-face relation.

Still another object is to provide a construction wherein the cover sections are provided at their upper ends with top walls having abuttable, radial stiffening ribs.

With the foregoing construction, the cover sections are readily interlocked in both their face-to-face relation and their nested relation, without any necessity for any auxiliary interlocking means. Thus, the invention provides a protective cover which performs its intended function very effectively, but which occupies a minimum of space during transport and storage, which are important features.

Another embodiment of the invention may be summarized as comprising, and an important object of the invention is to provide a cover which comprises a unitary, upwardly converging housing being formed into a frusto-conical cover having overlapping edges removably connected together by longitudinal seam means. When the cover is not in use the edges may be disconnected and the cover stored flat.

As in the previously described embodiment, another object of this invention is to provide a protective cover wherein the seam means comprises fastening means on the edge portions for interlocking the edges.

Still another object is to provide a construction wherein the fastening means comprises detachable fasteners.

Yet another object of the invention is to provide a cover with a removably fastened cap to the top of the body of the cover to form a frusto-conical chamber for the cake.

An additional object is to provide a construction wherein the cap is removably fastened to the body of the cover by fastening means comprising detachable fasteners.

The foregoing objects, advantages, features and results of the present invention, together with various other objects, advantages, features and results which will be evident to those skilled in the protective cover art in the light of this disclosure, may be achieved with the exemplary embodiment of the invention illustrated in the accompanying drawing, and described in detail hereinafter.

DESCRIPTION OF THE EXEMPLARY EMBODIMENTS OF THE INVENTION

Figure 1:
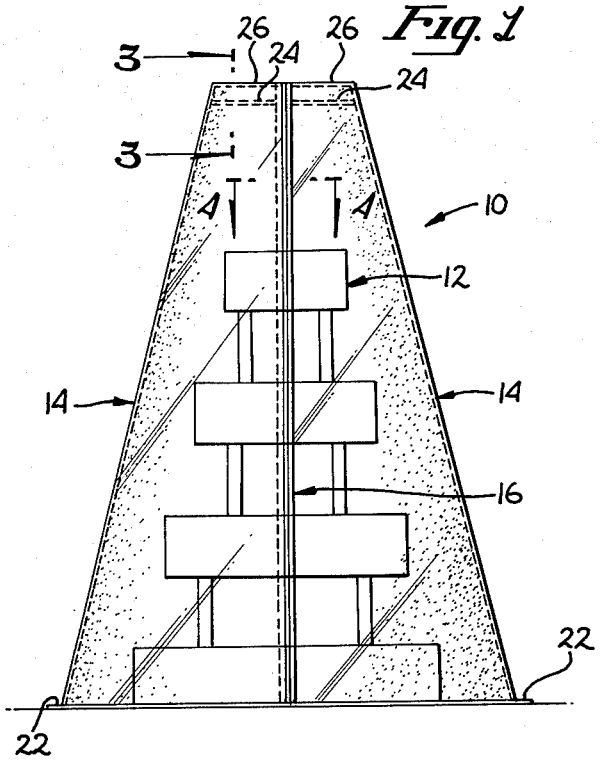
FIG. 1 is a side elevational view of one embodiment of the invention, FIG. 1 further showing that the protective cover has a frusto-conical configuration and is divided into two halves in a substantially vertical plane containing the axis of the cover, the two halves being disposed in face-to-face relation when the cover is in its operative condition.

Referring to the drawing, designated generally therein by the numeral 10 is a frusto-conical protective cover for a wedding cake 12. The specific cover 10 shown is divided into two identical sections or halves 14 in a substantially vertical plane containing the axis of the cover. However, the cover 10 may be divided vertically into more than two identical sections, e.g., three or four. For convenience, this portion of the present specification will be restricted to a disclosure of the two cover halves 14 specifically shown.

Figure 2:
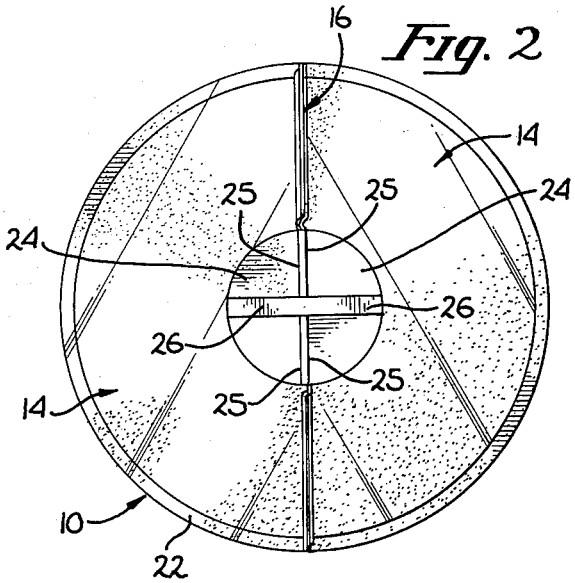
FIG. 2 is a top plan view of one embodiment of the protective cover in the condition in which it is shown in FIG. 1 of the drawing.
Figure 4:
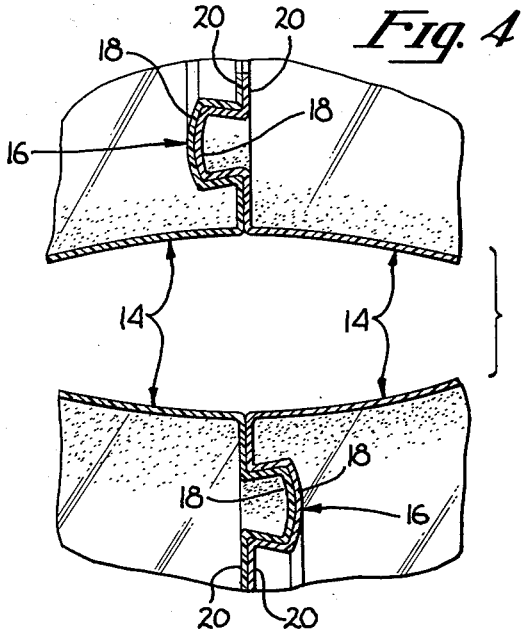
Figure 5:
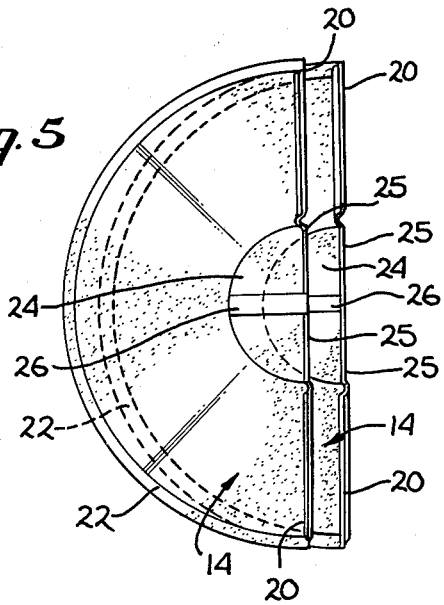
FIG. 5 is a top plan view showing the two cover halves in a partially nested condition or relation.

The cover halves 14 are positionable in face-to-face relation, as shown in FIGS. 1, 2 and 4, to form the cover 10. When the cover 10 is not in use, as during storage or shipment, the two cover halves 14 are positionable in nested relation, the two halves being shown partially nested in FIG. 5, and being shown fragmentarily in a completely nested condition in FIG. 6.

The protective cover 10 is preferably formed of a transparent plastic material so that the wedding cake 12 can be viewed therethrough readily. The transparent plastic material forming the protective cover is sufficiently thick that the cover is self supporting. However, the plastic material is thin enough to render the cover halves 14 flexible for a purpose to be described.

Figure 6:
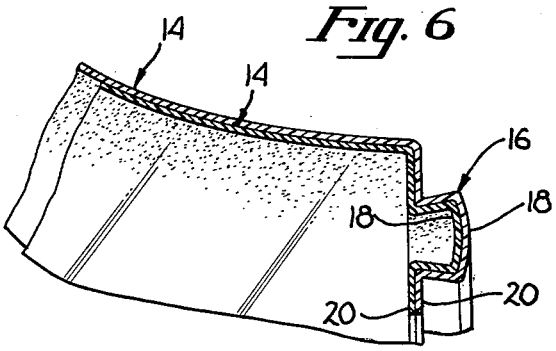
FIG. 6 is an enlarged, fragmentary sectional view showing the manner in which the two cover halves are interlocked in their fully nested condition or relation.

The protective cover 10 includes integral interlocking means 16 located at the seam formed by the overlap of the cover halves 14 for interlocking same with the cover halves in either their face-to-face relation, as shown in FIGS. 1, 2 and 4, or in their nested relation, as shown in FIG. 6. More particularly, the interlocking means 16 comprises dovetail channels 18 interlocable with snap fits and formed in outwardly extending, upwardly convergent flanges 20 extending outwardly from the respective upwardly convergent edges of the cover halves 14.

More particularly, there are two of the upwardly convergent, outwardly extending flanges 20 on each cover half 14, and each such flange has one of the dovetail channels 18 formed therein. As will be apparent from FIG. 4, the channels 18 in each cover half 14 face in opposite directions when viewed from above. Considered from an alternative standpoint, the channels 18 in each cover half face clockwise when viewed from above.

The channels 18 are interengageable with snap fits, the plastic material of the cover halves 14 being sufficiently flexible to achieve such fits. Thus, when the cover halves 14 are in their face-to-face relation, as shown in FIGS. 1, 2 and 4, to fom the protective cover 10, the four channel 18 are interlocked with snap fits, as best shown in FIG. 4. When the cover halves are in their nested relation, the channels 18 are interlocked, as will be clear from the two channels shown in FIG. 6.

Thus, the interlocking means 16 integral with the cover halves 14 operates in substantially the same way in both the face-to-face relation of the cover halves 14 and the nested relation thereof. More particularly, each channel 18 on one of the cover halves 14 is interlockable with one of the channels 18 on the other of the cover halves 14 when the cover halves are in their face-to-face relation, and is interlockable with the other of the channels 18 on such other cover half 14 when the cover halves are in their nested relation.

For stability in the operating condition of the protective cover 10 (and in the nested condition thereof), the cover halves 14 are provided at their lower, larger ends with outwardly extending, semiannular base flanges 22. When the cover halves 14 are in their face-to-face relation, the two semiannular base flanges 22 cooperate to provide an annular base flange for the over-all protective cover 10.

Figure 3:
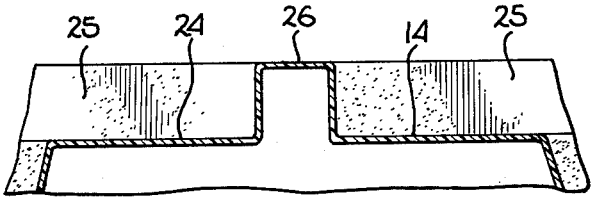
FIGS. 3 and 4 are enlarged, fragmentary sectional views, respectively, taken as indicated by the arrowed lines 3—3 and 4—4 of FIG. 1.

The cover halves 14 are provided at their upper ends with semicircular top walls 24, the diametral edges of which have flanges 25 abutting when the cover halves are in their face-to-face relation. The top walls 24 also have abuttable, radial stiffening ribs 26, best shown in FIGS. 2 and 3 of the drawing.

Figure 7:
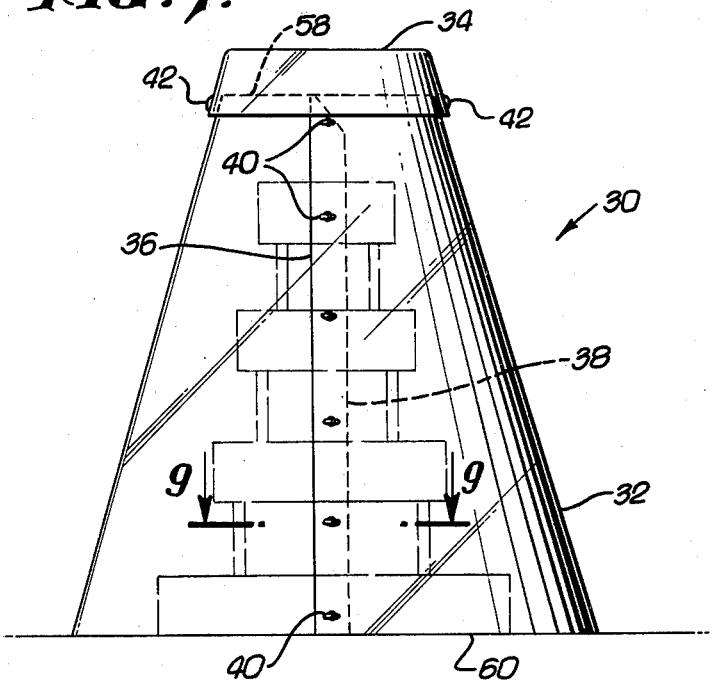
FIG. 7 is a side elevational view of another embodiment of the invention.
Figure 8:
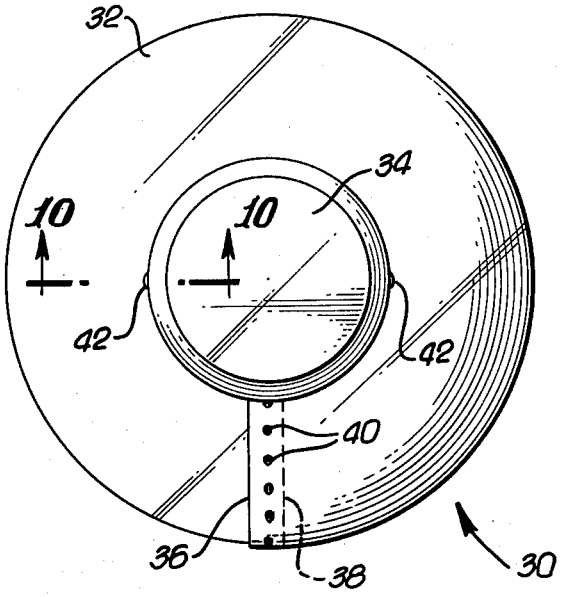
FIG. 8 is a top plan view of another embodiment of the protective cover in the condition in which it is shown in FIG. 7 of the drawing.

Referring now to FIGS. 7 and 8, there is illustrated therein another embodiment of applicant's invention. The casing 30 which includes a base 32 and a top 34 is preferably formed of the same material as the aforesaid embodiment.

The base 32 is a unitary member encircling the longitudinal axis of the casing 30 so that there is formed a seam by the overlap of an outer edge 36 over an inner edge 38 of the base. The base 32 is held in a frusto-conical configuration by means of detachable fasteners 40. In this configuration, there is formed a bottom edge 60 abutting a base and a top edge 58.

Figure 9:
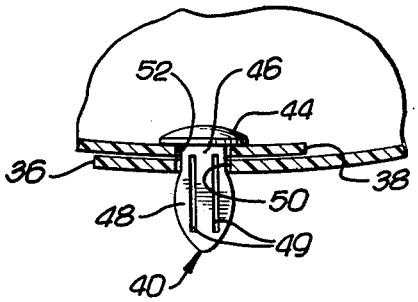
FIGS. 9 and 10 are enlarged, fragmentary sectional views, respectively, taken as indicated by the arrowed lines 9—9 and 10—10 of FIGS. 7 and 8, respectively.

Referring now to FIG. 9, there is illustrated an enlargement of one of the fasteners 40 and surrounding area of the base. The fastener 40 includes a head 44 and a neck 46. The neck 46 projects through an inner aperture 52, located near the inner edge 38 of the base 10, and an outer aperture 50 located near the outer edge 36.

The detachable fastener 40 has an enlarged end 48 having slots 49. The enlarged end 48 permits the detachable fastener to be retained in the outer and inner apertures 50 and 52, but easily removable without damage to either aperture or the fastener itself due to radially inward flexure of the enlarged end as the fastener is passed through the apertures.

The unitary top 34 has a flat upper surface and downwardly diverging sides. The diameter of the bottom edge of the top 34 is slightly greater than the diameter of the top edge 58 of the base 32, so that the bottom edge of the top overlaps the top edge of the base. The top is affixed to the base by means of detachable fasteners 42 which are similar to detachable fasteners 40.

Figure 10:
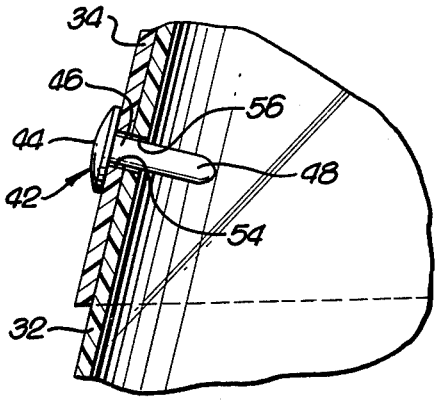

Referring now to FIG. 10, there is illustrated an enlargement of detachable fastener 42 and the surrounding area of the top and base. The enlarged end 48 of the detachable fastener 42 is passed through an outer layer aperture 54 in the top 34 and an inner layer aperture 56 in the base 32 so that the heat 44 abuts the top and the apertures 54 and 56 are in the vicinity of the neck 46. The detachable fastener is retained and may be detached in the aforesaid manner.

When assembled, the casing 30 is placed over the articles to be protected so that the bottom edge 60 abuts the surface on which the objects are resting.

When it is desired to store the casing, the detachable fasteners 40 and 42 are removed and the base flattened so that both pieces of the casing are easily storable and take up a minimum amount of space.

Although two exemplary embodiments of the invention has been disclosed for illustrative purposes, it will be understood that various minor changes, modifications and substitutions may be incorporated in such embodiments without departing from the invention as defined by the claims hereinafter appearing.

What is claimed is:

1. A protective cover for decorative cakes and the like which rest on an underlying support surface, comprising a body portion formed of flexible transparent material with upstanding upwardly convergent walls and including overlapping edges removably connected together by seam means for enclosing the cake in a conical chamber formed between said body portion and the support surface, said body portion further including bottom edge means engaging the support surface at a location displaced from the outer edge of the cake for supporting said body portion over the cake without contacting the cake, and wherein said body portion comprises:

a unitary frusto-conical base member, having a single seam from the top edge to the bottom edge, formed by the overlapping edges of the walls of said base member;

a cap member having a substantially flat top portion and a downwardly divergent portion;

fastening means connected to said cap and base members for removably attaching said cap member to said base member.

2. The device of claim 1 wherein the top portion and bottom edge of said cap member is substantially circular and the diameter of said bottom edge is greater than or equal to the diameter of the top edge of said base.

3. The device of claim 1 wherein said seam means comprises the overlapping edges of the walls of said base member and fastening means connected to the walls of said base member for removably securing said walls together.

4. The device of claim 3 wherein the overlapping edge of the walls of said base have a plurality of corresponding holes and said fastening means comprises a plurality of detachable fasteners removably inserted into said holes.

5. A protective cover for decorative cakes and the like which rest on an underlying support surface, comprising a body portion formed of flexible transparent material with upstanding upwardly convergent walls and including overlapping edges removably connected together by seam means for enclosing the cake in a conical chamber formed between said body portion and the support surface, said body portion further including bottom edge means engaging the support surface at a location displaced from the outer edge of the cake for supporting said body portion over the cake without contacting the cake, and wherein said body portion comprises:

a unitary frusto-conical base member, having a single seam from the top edge to the bottom edge, formed by the overlapping edges of the walls of said base member;

a cap member having a substantially flat top portion and a downwardly divergent portion;

fastening means connected to said cap and base members for removably attaching said cap member to said base member;

and wherein the downwardly divergent portion of said cap member overlaps and encircles the top edge of said base member.

* * * * *